US006241081B1

(12) United States Patent
Holden

(10) Patent No.: US 6,241,081 B1
(45) Date of Patent: Jun. 5, 2001

(54) MODIFIED SPIRAL SEAM ARRANGEMENT

(75) Inventor: David Holden, Blackburn (GB)

(73) Assignee: Voith Fabrics Heidenheim GmbH & Co. KG, Heidenheim (DE)

( * ) Notice: Subject to any disclaimer, the term of this patent is extended or adjusted under 35 U.S.C. 154(b) by 0 days.

(21) Appl. No.: 09/355,963

(22) PCT Filed: Feb. 18, 1998

(86) PCT No.: PCT/GB98/00361

§ 371 Date: Aug. 21, 1999

§ 102(e) Date: Aug. 21, 1999

(87) PCT Pub. No.: WO98/37272

PCT Pub. Date: Aug. 27, 1998

(30) Foreign Application Priority Data

Feb. 18, 1997 (GB) ..... 9703297

(51) Int. Cl.[7] ..... D21F 1/00
(52) U.S. Cl. ..... 198/844.2
(58) Field of Search ..... 198/844.2; 24/34, 24/39; 474/218, 221

(56) References Cited

U.S. PATENT DOCUMENTS 3,436,041 * 4/1969 Haller ..... 24/34
4,695,015 * 9/1987 Salminen ..... 198/848
5,065,860 * 11/1991 Faulkner ..... 198/848
5,275,858 * 1/1994 Hock ..... 198/844.2
5,405,669 * 4/1995 Lidar ..... 198/844.2
5,908,106 * 6/1999 Krueger ..... 198/848

FOREIGN PATENT DOCUMENTS 12 51 105 9/1967 (DE) .
0 275 656 7/1988 (EP) .
0 364 066 4/1990 (EP) .

* cited by examiner

*Primary Examiner*—Douglas Hess
(74) *Attorney, Agent, or Firm*—Caesar, Rivise, Bernstein, Cohen & Pokotilow, Ltd.

(57) ABSTRACT

A seam arrangement for connecting the two ends of a fabric so as to form an endless belt, particularly for use in paper-making. The seam arrangement comprises two endless coils (10) which are respectively located at the free ends of the fabric and on interdigitation are brought into union by a pintle wire. Each loop of the coils (10) is secured by a "short" fabric loop (22) and a "long" fabric loop (18). The short fabric loop is located at the right hand side of the long fabric loop when looking up the fabric towards the seam.

2 Claims, 1 Drawing Sheet

MODIFIED SPIRAL SEAM ARRANGEMENT

This invention relates to a modified spiral seam arrangement.

Spiral seams are used for example to connect the ends of fabrics to form endless belts for use in paper machine clothing, especially press felt base cloths or dryer fabrics.

In a spiral seam, the ends of a fabric are provided at each edge to be formed with a loop structure capable of interdigitating with a corresponding loop structure on the opposite edge, and the seam is usually secured by means of a pintle wire or rod extending axially through the interdigitated loops. Conveniently, the loops are provided by means of a pair of, preferably flattened, helical coils, each formed from a single continuous metal wire, plastic coated wire, or suitable plastic monofilament. The helical coils are woven into the fabric, or otherwise secured depending upon the nature of the substrate. One side of the spiral is substantially flatter than the other so that the loops are substantially D shaped, the flatter sides being directed towards the paper supporting surface of the fabric in plan view, from the more curved side, each loop of the spiral has an N-shape.

Machine direction (MD) warp yarns are woven in repeat groups of four to each turn of the helical coil. Alternate yarns run short, and the remaining spaced yarns extend into the fringed area and are looped around the leg of the coil adjacent the seam, and a return portion of each is back woven into the fabric in the space made available by the yarns which have run short to in effect provide a continuous warp path.

The weave pattern is such that one of the MD yarns forms a "long"fabric loop, floated over at least the last cross machine weft yarn, and the other a "short"fabric loop coming from below the last weft yarn or floated over fewer yarns than the "long" fabric loop. In the known fabric seam the "short" fabric loop lies between the diagonal and the left hand vertical limb of the N-shape of the spiral coil loop. In this arrangement the "short" fabric loop distorts the coil loop to such an extent that part of the seam moves proud of the belt. This results in undesirable marking of the paper which is being manufactured on the belt.

According to the present invention there is provided a seam arrangement for connecting the ends of a fabric so as to form an endless belt, the seam arrangement comprising a first coil provided at one of said ends of the fabric and a second coil provided at the other of said ends of the fabric, wherein the two coils are operable to be interdigitated and secured together by means of a pintle wire which may be passed through the interdigitated coil loops, and wherein two machine direction yarns of the fabric are passed through each loop of a coil so as to secure the coil to the fabric edge, the machine direction yarns associated with each coil loop providing a "long" fabric loop and a "short" fabric loop, characterised in that each coil loop notionally forms an N-shape with the top of the N-shape being provided by the free ends of the coil loop which are remote from the fabric end to which that coil loop is secured, and in that the "short" fabric loop lies between the "lon" fabric loop and the right hand limb of the N-shape of the spiral coil loop.

Space for back-weaving the MD yarns is created by terminating selected MD yarns short of the edge region, at a joining point, and the return portions back woven to the joining point so that there is no perceptible break in the weave. The MD yarns would preferably be warp yarns.

It has been found that an arrangement of this kind allows the spiral coil to be seated closer into the plane of the fabric, so that the coil stands less proud and thus reduces the extent or depth of any embossing or marking inflicted by the coil on paper which is supported on the fabric and the less proud configuration of the seam makes it less prone to wear.

An embodiment of the invention will now be briefly described with reference to the accompanying drawings wherein.

Figure 1:
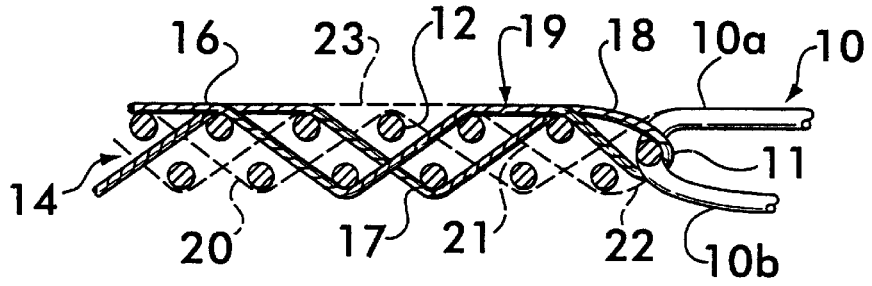
FIG.1 (Prior Art)
FIG. 1 is a sectional weave diagram of a seam of a known form of helical seam.
Figure 2:
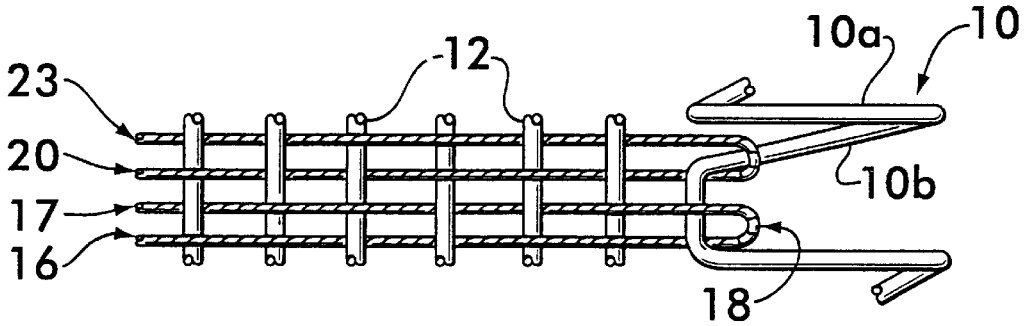
FIG.2 (Prior Art)
FIG. 2 is a diagrammatic plan view showing the weave of the seam of FIG. 1 from above.

In a prior art spiral seam, as illustrated diagrammatically in FIGS. 1 and 2, a flattened helical coil member 10 has a large number of turns, each having a leg 11, alongside the edge of the woven fabric. The coil 10 is flatter on its upperside 10*a*, than on its lower side 10*b*, thus providing a 'D' shaped outline. In plan (as seen from FIG. 2) each loop has the shape of an 'N' with the lower side parts 10*b* forming the diagonal of the N-shape. In the example, the fabric comprises two layers of cross-machine direction weft yarns, 12, with an upper layer and a lower layer of staggered yams. Machine direction warp yarns 14 are woven through the weft yarns 12 in a pattern wherein each warp yarn floats over two weft yarns in the upper layer, and passes under one weft yam in the lower layer in each repeat.

The seam is formed with two MD yarns for each turn of the coil member 10, a first MD yarn 16, shown in FIG. 1 as a continuous double line, has a main part 19 which forms a "long" fabric loop 18, over the last two upper layer cross-machine yarns and under and around the leg 11 of the coil adjacent the fabric edge. The yams nest in the 'V' between the nearer end of each coil upper side 10*a* and lower side 10*b*, with the "short" fabric loop 22 nesting on the apex of the 'V' and the "long" fabric loop 18 further out on the part 10*b*. The return section 17 of the MD yarn 16 passes over the leg 11, and then passes over the upper yarn adjacent the seam, and is back woven into the fabric for a few repeats. The weave space is filled by a normal MD yarn, which is cut short to terminate adjacent the woven back end of section 17. (This is not shown in the drawings).

A second MD yarn 20 has a main part 21 which forms a "short" fabric loop 22, as it emerges from below the last bottom layer cross-machine yarn and below the last upper layer yarn to pass under and around the leg 11, adjacent the "long" fabric loop 18. After it passes about the leg 11 of the spiral yam 20 forms a return portion 23 which passes over the last cross-machine yarn and is then woven back into the fabric for several repeats. As with the woven-back end 19 of yarn 16, the space for this is provided by cutting short a normal MD yarn.

As can best be seen from FIG. 2, the return portions 17, 23 of yams 16, 20 are located alternatingly with the main portions, the sequence from top to bottom of the figure being: main part 21 of yarn 20 (short fabric loop); return part 23 of yarn 20; main part 19 of yarn 16 (long fabric loop); return part 17 of yarn 16.

The fabric loops 18,22 pass about the lower part 10*b* of the spiral.

It can be seen from FIG. 2 that the "short" fabric loop distorts the N-shape of the coil loop, forcing the diagonal 11 upwards in a direction perpendicular to the plane of the fabric, resulting in a proud seam. When viewed from above the N-shape can be seen to be significantly distorted. The "long" fabric loop is consequently less tightly bound around the diagonal and consequently it contributes less to seam strength.

Figure 3:
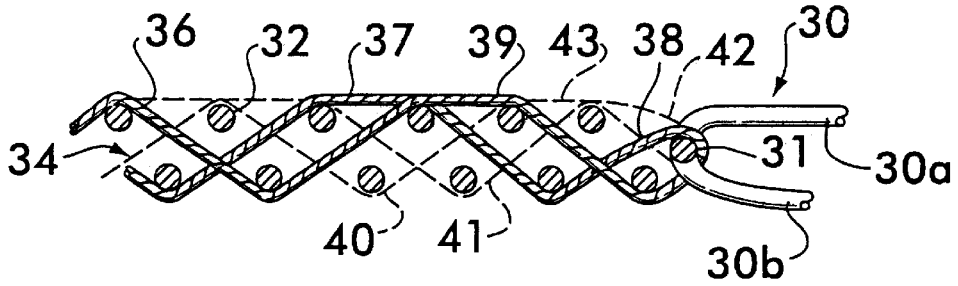
FIG. 3 is a diagram corresponding to FIG. 1 showing the weave of a seam according to the invention.
Figure 4:
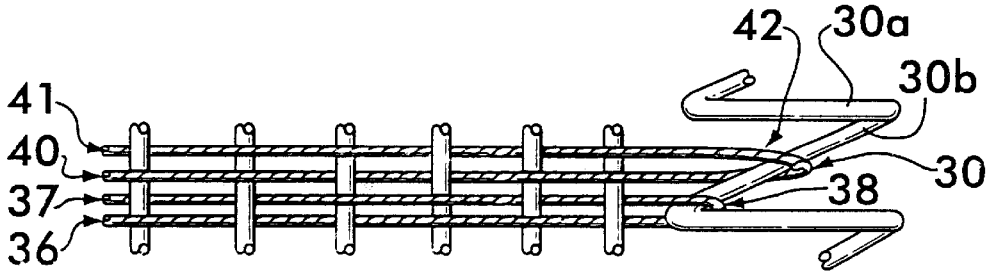
FIG. 4 is a diagrammatic plan view, similar to FIG. 2 of the seam of FIG. 3.

FIGS. 3 and 4 illustrate the weave pattern of a spiral seam arrangement according to the invention. The arrangement of cross-machine direction weft yams 32 is the same as that of FIG. 1—upper and lower layers with the yarns staggered, and a helical coil member 30 which is of the same configuration as that of FIG. 1 with more flattened upper parts 30*a* and more bowed lower parts 30*b*, appearing in plan view as an 'N' shape. The machine direction warp yarns 34 are again woven through the weft yarns 32 in a pattern wherein each warp yarn floats over two weft yarns in the upper layer, and passes below one weft yarn in the lower layer in each repeat.

The seam is formed with two MD warp yarns for each turn of the coil member 30. A first MD yarn 36, shown in FIG. 3 is a continuous double line, has a main part 39 which forms a "short" fabric loop 38, passing below the last cross-machine yarn of the upper layer and under the last cross-machine yam of the lower layer, about the part 30*b*, and then returns below the last two cross-machine yams of the upper layer, to form a return portion 37 which is back woven into the fabric for several repeats. The weave space is created by ending a normal MD yam to terminate in a joining zone with the end of woven-back portion 37. (This is not shown in the drawing).

A second MD yarn 40 is shown in FIG. 3 as a dashed broken line, and has a main part 43 which forms a "long" fabric loop 42 which passes over the last two upper layer cross-machine yarns, about the part 30*b* of the coil, and passes over the coil, to form a return portion 41, which passes over the last cross-machine yarn, to be woven back into the fabric for several repeats. As FIG. 4 shows, the arrangement of the main and return yarn portions is different from that shown in FIG. 2.

The FIG. 4 arrangement in practice has the effect that the spiral is less distorted by its connection with the fabric ends and is seated better into the plane of the fabric, thus reducing marking of any paper supported on the fabric. The seam stands less proud and is also less prone to wear than previous seams. The seam achieves a far stronger seam with respect to the length direction of the fabric and the coil is less prone to rotating, so that interdigitation of the two opposed loop structures during fabric seaming is made easier.

It is to be understood that the embodiment described with reference to FIGS. 3 and 4 is by way of illustration only. Many modifications and variations are possible.

What is claimed is:

1. A seam arrangement for connecting the ends of a fabric so as to form an endless belt, the seam arrangement comprising a first coil provided at one of said ends of the fabric and a second coil provided at the other of said ends of the fabric, wherein the two coils are operable to be interdigitated and secured together by means of a pintle wire which may be passed through the interdigitated coil loops, and wherein two machine direction yarns of the fabric are passed through each loop of a coil so as to secure the coil to the fabric end, the machine direction yarns associated with each coil loop providing a "long" fabric loop and a "short" fabric loop, characterised in that each coil loop notionally forms an N-shape, with the top of the N-shape being provided by free ends of the coil loop which are remote from the fabric end to which that coil loop is secured, and in that the "short" fabric loop lies between the "long" fabric loop and a right hand limb of the N-shape of the coil loop.

2. A modified spiral seam arrangement as claimed in claim 1, wherein a number of machine direction yarns are terminated short of the fabric end, at a joining point, and a return portion back woven to the joining point.

* * * * *